US007887035B2

(12) United States Patent
Herda et al.

(10) Patent No.: US 7,887,035 B2
(45) Date of Patent: Feb. 15, 2011

(54) FAN DELIVERY FOR A FOLDING APPARATUS

(75) Inventors: Philippe Herda, Nogent sur Oise (FR); Jérôme Peres, Montataire (FR)

(73) Assignee: Goss International Montataire SA, Montataire (FR)

( * ) Notice: Subject to any disclaimer, the term of this patent is extended or adjusted under 35 U.S.C. 154(b) by 433 days.

(21) Appl. No.: 11/547,408

(22) PCT Filed: Mar. 31, 2005

(86) PCT No.: PCT/IB2005/000883

§ 371 (c)(1),
(2), (4) Date: Sep. 25, 2008

(87) PCT Pub. No.: WO2005/095242

PCT Pub. Date: Oct. 13, 2005

(65) Prior Publication Data

US 2009/0014938 A1 Jan. 15, 2009

(30) Foreign Application Priority Data

Apr. 1, 2004 (DE) ..... 10 2004 016 109

(51) Int. Cl.
*B65H 29/20* (2006.01)

(52) U.S. Cl. ..... 270/47; 270/13; 270/19; 270/42; 270/43

(58) Field of Classification Search ..... 270/6, 270/10, 13, 19, 42, 43, 47; 271/187, 315
See application file for complete search history.

(56) References Cited

U.S. PATENT DOCUMENTS 2,172,364 A 9/1939 De Manna
2,403,062 A 7/1946 James
4,088,314 A 5/1978 Phillips
5,028,045 A 7/1991 Muller
5,040,783 A 8/1991 Ruehl
5,083,998 A 1/1992 Carter
5,123,638 A 6/1992 Mutou
5,156,389 A 10/1992 Novick
5,322,270 A 6/1994 Belanger et al.
5,630,584 A 5/1997 Seeber
5,775,682 A 7/1998 Hosking et al.
6,000,334 A 12/1999 Suzuki (Continued)

FOREIGN PATENT DOCUMENTS

DE 23 16 934 A1 11/1973

(Continued)

OTHER PUBLICATIONS

Communication from European Patent Office dated Jul. 15, 2009 regarding EP 05 718 355.0, 5 pages.

*Primary Examiner*—Leslie A Nicholson, III
(74) *Attorney, Agent, or Firm*—Davidson, Davidson & Kappel, LLC

(57) ABSTRACT

A fan delivery for a folding apparatus is provided, having at least one fan wheel including a number of fan-wheel elements and having a signature guide member that is movable relative to the fan wheel, in which the signature guide member has at least one arm that is introducible into a space defined by two fan-wheel elements. A folding apparatus is also provided.

5 Claims, 4 Drawing Sheets

U.S. PATENT DOCUMENTS

| | | | | |
|---|---|---|---|---|
| 6,131,903 | A * | 10/2000 | Schaefer et al. | 271/312 |
| 6,231,044 | B1 | 5/2001 | Neary et al. | |
| 6,464,218 | B2 * | 10/2002 | Neary et al. | 271/270 |
| 7,470,102 | B2 * | 12/2008 | Gendron et al. | 414/796 |
| 2003/0082044 | A1 * | 5/2003 | Gendron et al. | 414/789.9 |

FOREIGN PATENT DOCUMENTS

| | | | |
|---|---|---|---|
| DE | 19955782 | A1 | 7/2000 |
| DE | 19931744 | | 2/2001 |
| DE | 69610016 | T | 2/2001 |
| EP | 0527317 | A2 | 2/1993 |
| EP | 0673868 | A2 | 9/1995 |
| EP | 0900756 | A1 | 3/1999 |
| JP | 48 008303 | U | 1/1973 |
| JP | 58172152 | | 10/1983 |
| JP | 62-23256 | U | 2/1987 |
| JP | 2-295849 | A | 12/1990 |
| JP | 2000-95405 | A | 4/2000 |
| WO | WO 2004/013025 | A1 | 2/2004 |

* cited by examiner

FAN DELIVERY FOR A FOLDING APPARATUS

BACKGROUND

The present invention is directed to a fan delivery or fan-wheel delivery unit for a folding apparatus, having at least one fan wheel including a number of fan-wheel elements and having a signature guide member that is movable relative to the fan wheel.

In folding apparatuses of web-fed rotary presses for commercial printing or for newspaper printing, one or more web substrates are folded together, cut, perforated and/or folded and processed into signatures, copies, booklets, printed products or folded sheets referred to simply as signatures in the following. The signatures are often delivered by a fan delivery from an upstream signature conveyor path to a downstream transport device, for example a conveyor belt, often in a shingle-stream formation. At high production speeds of often several ten thousand signatures per hour, the transfer of the signatures into and out of the fan-wheel pockets constitutes a critical process step. For this reason, in a fan delivery of the species, a signature guide member is assigned to a fan wheel in such a way that the process of receiving the signatures in the fan-wheel pockets, as well as each of the signatures received in one fan-wheel pocket are assisted in that portions of the signatures are guided or routed by the signature guide member.

A signature guide member for a fan wheel of a fan delivery in a folding apparatus is known, for example, from U.S. Pat. No. 6,000,334. The signature guide member includes a plurality of arms which can be moved close to the imaginary peripheral surface of the fan wheel, thereby enabling signatures received in the fan-wheel pockets to be contacted and guided until being delivered to a conveyor belt. The shape of the arms is adapted to the curvature of the fan wheel. The gap between the signature guide member and the fan wheel is adjustable; the signature guide member can be moved in a substantially horizontal direction. In addition, the signature guide member is sluable about an axis of rotation, so that access to the fan wheel is facilitated for maintenance work.

U.S. Pat. No. 5,156,389 describes a fan delivery having signature guide members which are able to be adjusted to conform with the format of the signatures to be delivered. The fan wheel is composed of fan-wheel elements, which are accommodated together with the signature guide members on a rotary shaft. The radial distances between the fan-wheel elements are variable, and the position of the signature guide members can likewise be varied, so that signatures of different formats, in particular having different widths, can be received by the fan-wheel pockets and delivered.

SUMMARY OF THE INVENTION

Depending on the format of the signatures, particularly when working with the various delta and digest formats familiar to one skilled in the art, the risk increases at high production speeds of signatures not being properly delivered or of being damaged when they are received or set down. For example, creases or dog's ears can form which unacceptably diminish the quality of the printed products.

An object of the present invention is to provide a reliable transfer of signatures in fan-wheel pockets of a fan delivery at high production speeds.

The present invention provides a fan delivery for a folding apparatus, having at least one fan wheel including a number of fan-wheel elements, has a signature guide member that is movable relative to the fan wheel and that has at least one arm or one tine that is introducible into a space defined by two fan-wheel elements. In other words, the arm is introducible into the intermediate space between two adjacent fan-wheel elements; to be precise, into the space which extends axially between two adjacent fan-wheel elements. In particular, this intermediate space may be the space defined by the projection of the outer peripheral line of the one fan-wheel element to the adjacent, other fan-wheel element along the common axis of rotation of the fan wheel. In this sense, the fan wheel meshes with the at least one arm. The fan delivery according to the present invention preferably has a signature guide member having a plurality of arms.

By introducing or inserting the at least one arm between two adjacent fan-wheel elements, small-format signatures, such as those in delta or digest format, also may be reliably and properly guided by one fan delivery during the delivery process.

In one preferred embodiment, in the fan delivery according to the present invention, the at least one arm may be sluable about an axis of rotation or rotary shaft into the space defined by two fan-wheel elements.

It is alternatively or additionally preferred when, in the fan delivery according to the present invention, the width of the fan-wheel elements is variable in the lateral direction, thus in parallel to the axis of rotation of the fan wheel. In other words, the distances between adjacent fan-wheel elements may be adjustable or variable. In this way, the intermediate spaces between adjacent fan-wheel elements may be adapted to the format of the signatures to be processed.

In particular, the signature guide member may have a plurality of arms mounted on a rotary shaft, the axial position of at least one of the arms being variable in a correlated manner as a function of the variation in the width of the fan-wheel elements. Moreover, provision may be made in the fan delivery according to the present invention for the mechanism for varying the width of the fan-wheel elements to be coupled to the mechanism for varying the axial position of at least one of the arms.

The signature guide member of the fan delivery according to the present invention may be movable by at least one pneumatic cylinder in such a way that the at least one arm is introducible into a space defined by two adjacent fan-wheel elements.

The present invention further provides a folding apparatus of a rotary offset press, in particular for commercial printing or for newspaper printing. The folding apparatus may be of the type that works with pins or of the type that works without pins, i.e., a folding apparatus that works with belt conveyor elements. The folding apparatus may be individually driven and/or be variable as a function of format changes. The folding apparatus may be a combination folding apparatus. In other words, a folding apparatus in accordance with the present invention of a rotary offset press has at least one fan delivery in accordance with this description.

BRIEF DESCRIPTION OF THE DRAWINGS

Further advantages, advantageous embodiments and refinements of the present invention are described with reference to the following figures, as well as their descriptions. Specifically, they show.

DETAILED DESCRIPTION OF PREFERRED EMBODIMENTS

Figure 1:
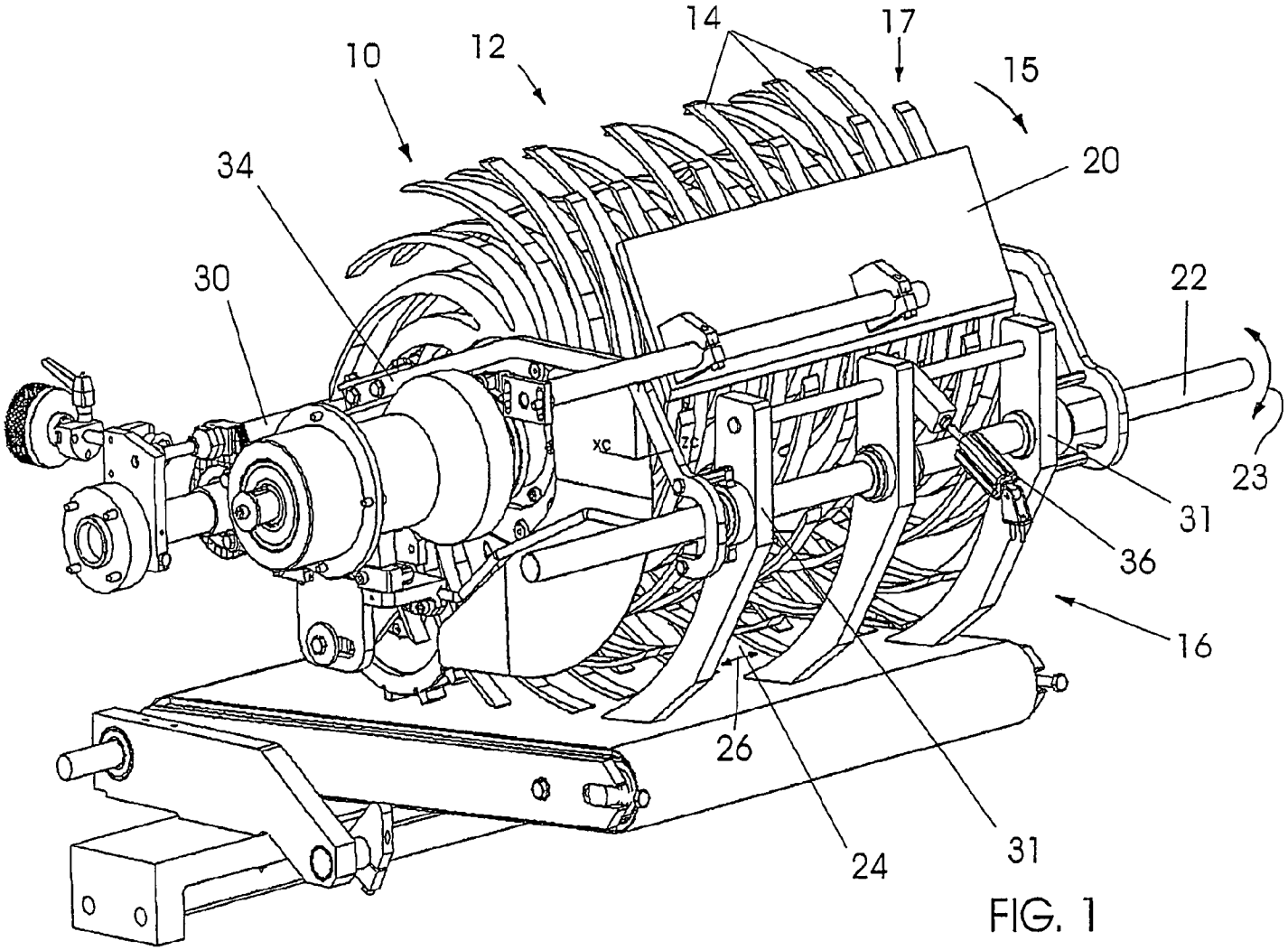
FIG. 1 a perspective representation of one embodiment of the fan delivery according to the present invention for a folding apparatus in a state in which the arms of the signature guide member are situated outside of the fan-wheel elements.

FIG. 1 shows a perspective view of one embodiment of fan delivery 10 or fan-wheel delivery unit according to the present invention for a folding apparatus in a state in which arms 18 of signature guide member 16 are situated outside of fan-wheel elements 14. The illustrated embodiment of fan delivery 10 includes a fan wheel 12 which has a plurality of fan-wheel elements 14 along its axis of rotation. Fan-wheel elements 14 have blades, for example, sickle- or saber-shaped, having intermediate spaces. The intermediate spaces substantially disposed along an azimuthal angle region form a fan-wheel pocket in which a signature may be received. During its operation, fan wheel 12 executes one rotation in direction of rotation 15. The illustrated embodiment of fan delivery 10 includes a signature guide member 16 which has three arms 18 and a signature guide surface 20 disposed upstream in signature feed direction 17. The signatures are deposited by fan wheel 12 onto a conveyor belt 38 in a shingle stream. Arms 18 are mounted on a rotary shaft 22, and their position relative to fan wheel 12 may be varied in a sluing motion 23 by pneumatic cylinder 36 (see, in particular, FIGS. 3 and 4). Disposed between adjacent fan-wheel pockets are spaces 24 having a width 26 into which an arm 18 may be swung or introduced. FIG. 1 illustrates a situation where arms 18 are not swung in between fan-wheel elements 14. Axial position 31 of arms 18 along rotary shaft 22 is also adjustable.

Figure 2:
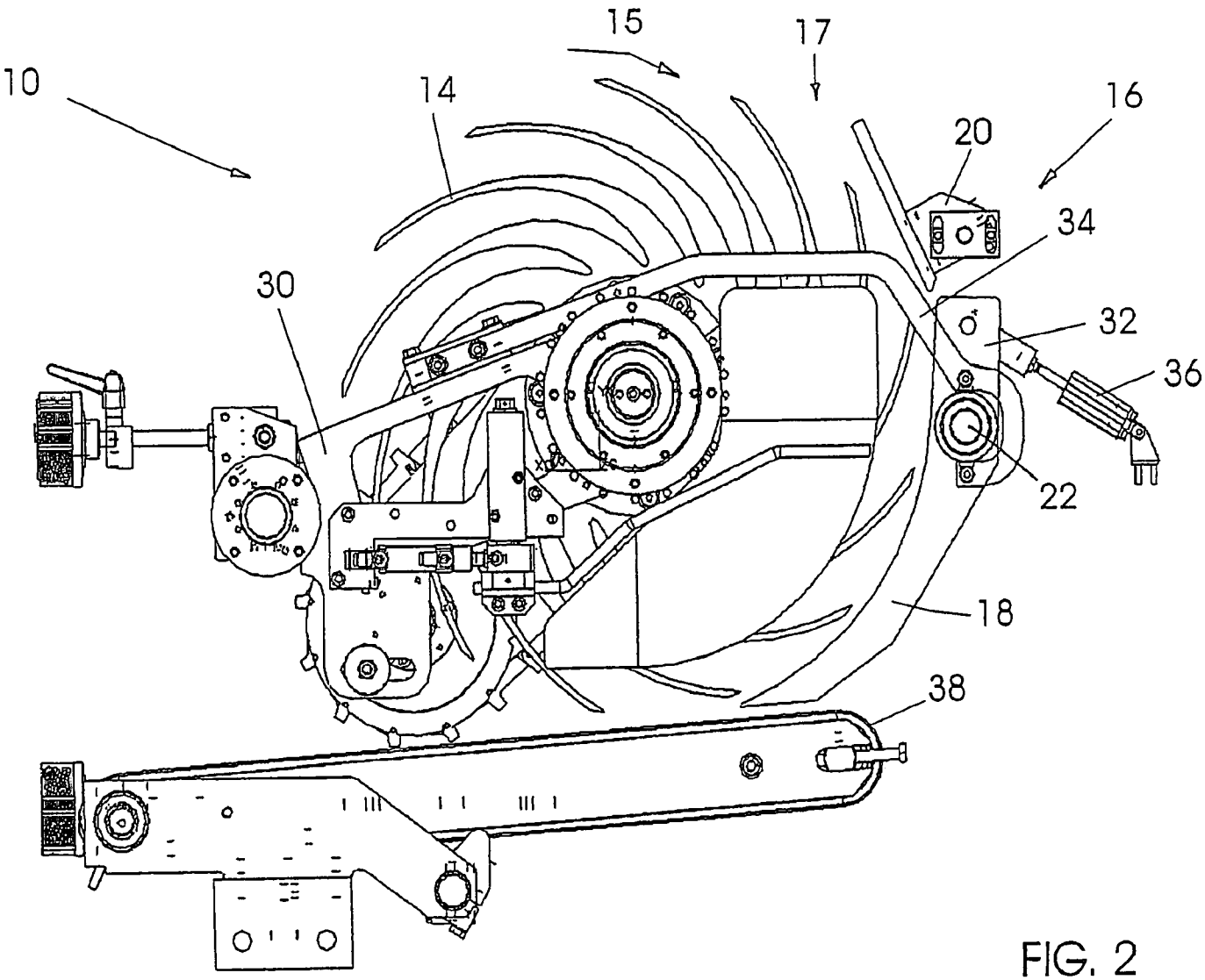
FIG. 2 a representation of the state of the specific embodiment shown in FIG. 1 in a view in parallel to the axis of rotation of the fan wheel.

FIG. 2 is a representation of the state of the specific embodiment shown in FIG. 1 in a view in parallel to the axis of rotation of fan wheel 10. When moved in direction of rotation 15, fan-wheel elements 14, of which one is shown here, receive signatures in their fan-wheel pockets that are carried along signature feed direction 17 and are assisted by signature guide surface 20 when being received in the fan-wheel pockets. A received signature is deposited from a fan-wheel pocket onto conveyor belt 38. As already explained with reference to FIG. 1, signature guide member 16 has arms 18, of which one is visible here, which, in response to the action of pneumatic cylinder 36, are sluable about a rotary shaft 22. As already discussed with reference to FIG. 1, width 26 of spaces 24, into which an arm 18 of signature guide element 16 may be swung, may be varied between adjacent fan-wheel elements 14. Mechanism 30 for varying mentioned width 26 (see FIG. 1) is coupled to mechanism 32 for varying axial position 31 (see likewise FIG. 1) by a connecting rod 34.

Figure 3:
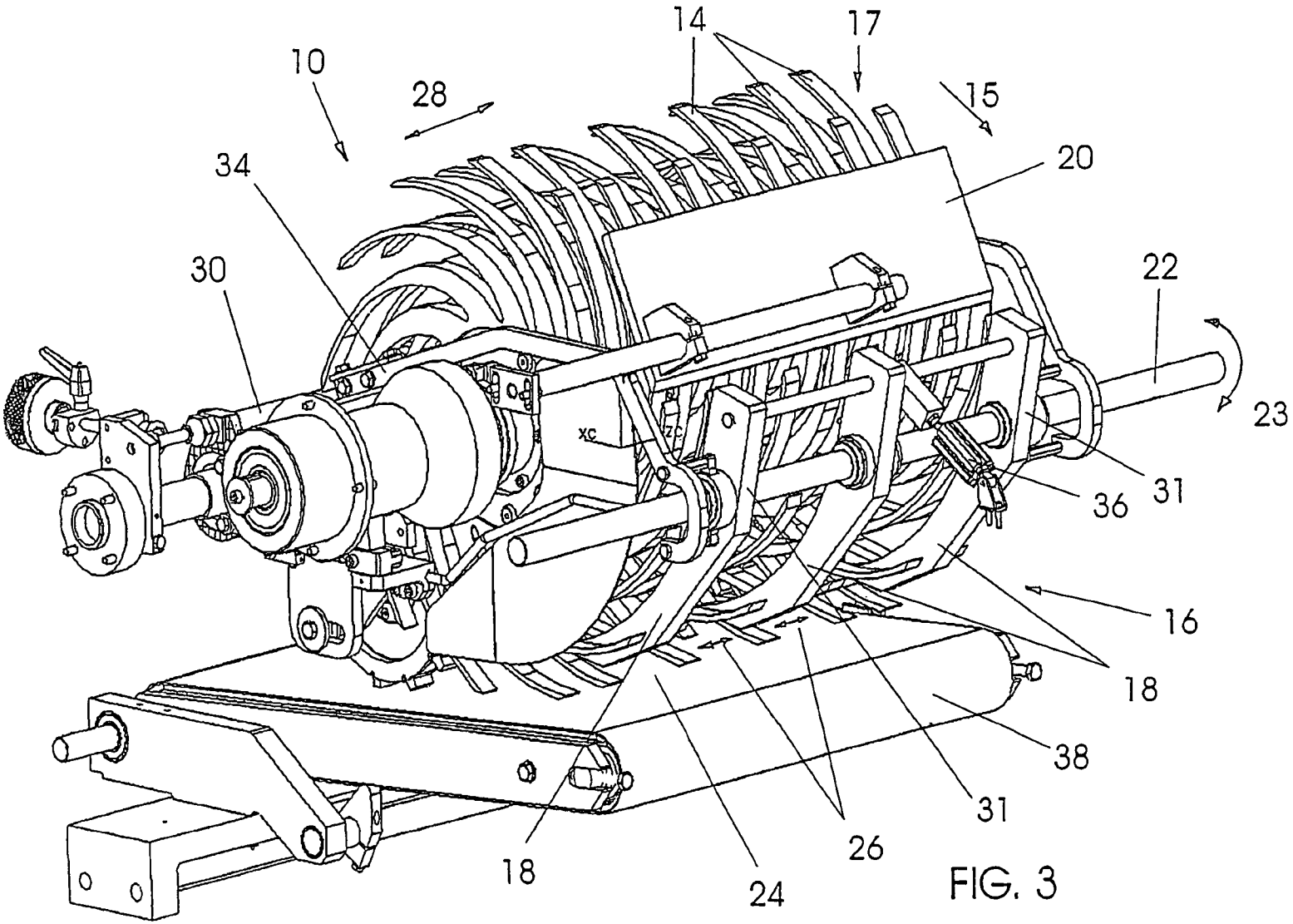
FIG. 3 a perspective representation of the same specific embodiment in another state in which the arms of the signature guide member are swung into spaces defined by two adjacent fan-wheel elements.

FIG. 3 relates schematically to a perspective representation of the same specific embodiment of fan delivery 10 in another state in which the three arms 18 of signature guide member 16 are each swung into spaces 24 defined by two adjacent fan-wheel elements 14. Sluing motion 23 about rotary shaft 22 of arms 18 is produced by a pneumatic cylinder 36. In response to motion of fan-wheel elements 14 in transversal direction 28, width 26 of spaces 24 is variable simultaneously or in a correlated manner with or as a function of a variation in the axial position of arms 18, since mechanism 30 for varying the width and mechanism 32 for varying the axial position are coupled by connecting rod 34, as previously explained with reference to FIGS. 1 and 2.

This specific embodiment including three arms 18 provides for axial position 31 of outer arms 18 to be variable, while middle arm 18 is centered with respect to the axial extent of fan wheel 12, and its position remains fixed in response to variation of width 26 of spaces 24.

Figure 4:
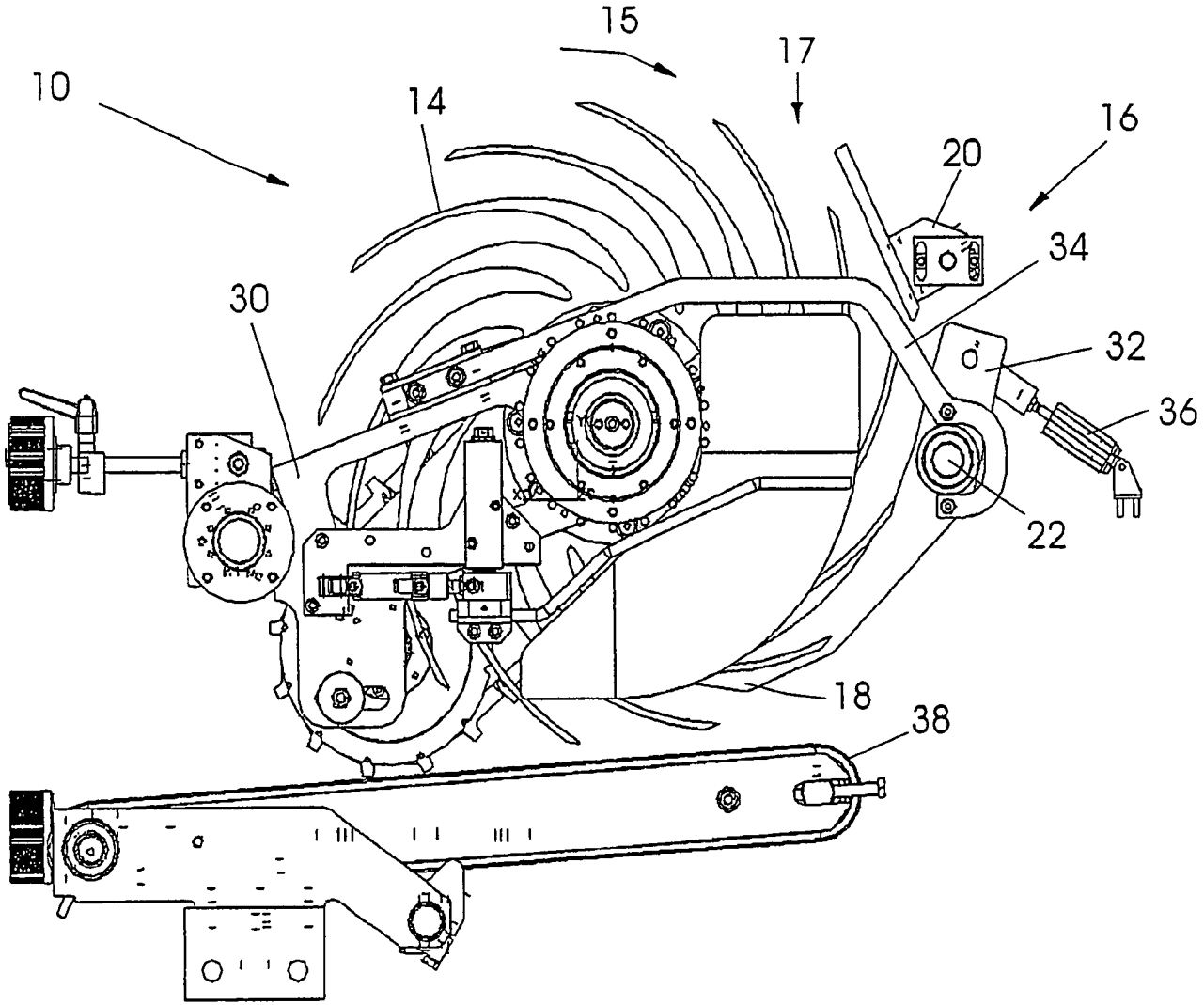
FIG. 4 a representation of the other state of the specific embodiment shown in FIG. 3 in a view in parallel to the axis of rotation of the fan wheel.

FIG. 4 represents the other state of the specific embodiment shown in FIG. 3 in a view in parallel to the axis of rotation of fan wheel 12. In this other state, signatures in the delta or digest format may be delivered in an especially advantageous manner by fan delivery 10 according to the present invention, since the effective depth of the fan-wheel pockets is reduced, and received signatures are guided by arms 18 of signature guide element 16 until they are delivered to conveyor belt 38.

For further clarification of the objects and directions provided with reference numerals in FIGS. 3 and 4, reference is made to the specification sections relating to FIGS. 1 and 2.

REFERENCE NUMERAL LIST

10 fan delivery
12 fan wheel
14 fan-wheel element
15 direction of rotation
16 signature guide member
17 signature feed direction
18 arm
20 signature guide surface
22 rotary shaft
23 sluing motion
24 space
26 width
28 lateral direction
30 mechanism for varying the width
31 axial position
32 mechanism for varying the axial position
34 connecting rod
36 pneumatic cylinder
38 conveyor belt

What is claimed is:

1. A fan delivery for a folding apparatus comprising:

at least one fan wheel including a plurality of fan-wheel elements forming a plurality of fan wheel pockets, the fan-wheel elements have at least two outermost fan-wheel elements defining an overall width of the fan-wheel elements, the overall width of the fan-wheel elements being variable in the lateral direction;

a signature guide member movable relative to the at least one fan wheel, the signature guide member including:

a plurality of arms mounted on a rotary shaft, an axial position of at least one of the arms variable in a manner correlated with the variation in the overall width of the fan-wheel elements;

at least one arm introducible into a space defined by two adjacent fan-wheel elements so the at least one arm extends axially between the two adjacent fan-wheel elements; and a first state in which the at least one arm is situated radially outside of the fan-wheel elements and a second state in which the at least one arm reduces an effective depth of at least one of the fan wheel pockets and guides at least one signature in the at least one of the fan wheel pockets until the at least one signature is delivered from the at least one of the fan wheel pockets to the conveyor;

a conveyor downstream of the at least one fan wheel; and a first mechanism varying the overall width of the fan-wheel elements and a second mechanism varying the axial position of at least one of the arms, the first and second mechanisms being coupled to one another.

2. The fan delivery as recited in claim 1 wherein at least one arm is sluable about a rotary shaft into the space defined by two adjacent fan-wheel elements.

3. The fan delivery as recited claim 1 wherein the signature guide member is movable by at least one pneumatic cylinder so at least one arm is introducible into the space defined by two adjacent fan-wheel elements.

4. A folding apparatus of a rotary offset press comprising: at least one fan delivery as recited in claim 1.

5. A fan delivery for a folding apparatus comprising:

at least one fan wheel including a plurality of fan-wheel elements, the fan-wheel elements having at least two outermost fan-wheel elements defining an overall width of the fan-wheel elements, the overall width of the fan-wheel elements being variable in the lateral direction;

a signature guide member movable relative to the at least one fan wheel;

a first mechanism varying the overall width of the fan-wheel elements; and a second mechanism varying the axial position of at least one of the arms, the first and second mechanism being coupled to one another;

the signature guide member having at least one arm introducible into a space defined by two adjacent fan-wheel elements;

the signature guide member including a plurality of arms mounted on a rotary shaft, an axial position of at least one of the arms variable in a manner correlated with the variation in the overall width of the fan-wheel elements.

* * * * *